United States Patent [19]

Svirschevsky et al.

[11] 4,230,191

[45] Oct. 28, 1980

[54] MACHINE FOR MAKING UNDERGROUND EXCAVATIONS

[76] Inventors: Valentin K. Svirschevsky, Krasny prospekt, 98, kv. 103; Andrei A. Trofimuk, Zolotodolinskaya ulitsa, 87; Gennady G. Vasiliev, ulitsa Novogodnaya 28, kv. 17; Ivan P. Leonov, ulitsa Tikhvinskaya, 2, kv. 38, all of Novosibirsk, U.S.S.R.

[21] Appl. No.: 6,115

[22] Filed: Jan. 24, 1979

[51] Int. Cl.[2] ..... E21B 11/02; E21B 1/06

[52] U.S. Cl. ..... 175/20; 175/62; 175/94; 175/404; 175/408

[58] Field of Search ..... 175/20, 55, 62, 94, 175/104, 325, 334, 335, 345, 347, 399, 408, 404

[56] References Cited

U.S. PATENT DOCUMENTS

| | | | |
|---|---|---|---|
| 1,136,135 | 4/1915 | Hughes | 175/345 X |
| 2,124,414 | 7/1938 | Goldman | 175/334 |
| 2,794,623 | 6/1957 | Stokes | 175/400 X |
| 3,181,631 | 5/1965 | Nielsen | 175/403 X |
| 3,418,022 | 12/1968 | Peterson | 175/94 X |
| 3,926,267 | 12/1975 | Konstantinovich et al. | 175/19 |

*Primary Examiner*—Ernest R. Purser
*Assistant Examiner*—Richard E. Favreau
*Attorney, Agent, or Firm*—Holman & Stern

[57] ABSTRACT

A machine for making underground excavations by compacting soil comprises an eccentric shaft having journals on which there are mounted for a free rotation in a sequence, beginning from the front end, a conical member and tapered rolls forming in combination a conically expanding body. The eccentric shaft is coupled to a drive for rotation. The conical member has a through longitudinal diffuser passage, and the eccentric shaft also has a through longitudinal diffuser passage of a cross-sectional area enlarging in the direction away from the face of the excavation being made. The cross-sectional area of the passage of the conical member is smaller than the smallest cross-sectional area of the passage of the eccentric shaft by an amount such that the inside cross-sectional area of the passage of the conical member is substantially within the limits of the inside cross-sectional area of the passage of the eccentric shaft.

6 Claims, 6 Drawing Figures

MACHINE FOR MAKING UNDERGROUND EXCAVATIONS

FIELD OF THE INVENTION

The invention relates to the construction technology, and more particularly to machines for making underground excavations in soil by compacting the soil with partial excavation thereof.

The present invention may be used in driving horizontal underground communications preferably of a large diameter, as well as in making inclined and vertical excavations driven from the bottom up.

DESCRIPTION OF THE PRIOR ART

Known in the art is a machine for making underground excavations, in particular, holes by compacting soil and partially excavating it (cf. W.German Pat. No. 1,193,081), comprising a casing in the form of two tandem arranged tubes which are oppositely rotatable. Pockets are arranged externally of the tubes along a helical line, and rollers are rotatably mounted in the pockets. The helical line along which the rollers are mounted is of righthand direction on one portion of the casing and of lefthand direction on the other portion of the casing. In annular space between the casing and an imaginary described circle of the machine is mounted an electric motor for driving the machine. The front end edge of the casing is pointed. Upon energization of the motor, both portions of the casing start rotating in opposition to one another, and the rollers of both portions of the casing, having their axes turned away from one another in the opposite directions, roll over the hole wall along a helical path to cause the forwardly directed movement of the machine.

The pointed edge of the rotating casing is forced into soil, and the inner space of the casing is filled with the soil. When the machine is filled with the soil for the whole length, it is withdrawn backwards, the soil is extracted, and the cycle begins anew.

The disadvantage of the machine, which makes it practically inoperable, resides in that the diameter of the rollers compacting the hole wall is small compared with the diameter of the hole being made. The rollers result in the soil being separated from the wall hole and jamming the machine.

Another disadvantage resides in the method of forming the soil core by the axial percolation by means of the rotating casing of the machine. This method requires an application of a considerable axial force which cannot be provided by the rollers of relatively small diameter so that substantial energy losses from friction with the soil take place.

A third disadvantage is associated with the impossibility of accommodating a sufficiently powerful motor in a constricted annular space between the outer surface of the casing and the wall of the hole being made.

Known in the art is a machine for making underground excavations, in particular holes, in soil (cf. USSR Inventor's Certificate No. 407143) having a working member made in the form of a hollow eccentric shaft provided with tapered rolls mounted for rotation on the shaft journals. A conical auger having its vertex facing the tail portion of the machine is installed inside the front end portion of the shaft. The auger is designed to cut and transfer a portion of the soil into the interior of the machine wherein there is provided a mixer with a binding mortar. Feeding augers extend radially away from the mixer, which, together with a cylindrical roll mounted on the casing, are designed for placing the compacted soil and the mortar on the hole wall. The machine is fed by means of a hydraulic step-motion mechanism comprising jacks. A portion of the soil from the central portion of the hole being driven is loosened by the auger and fed to the mixer containing mortar. At the same time, the hole diameter is enlarged by compacting the soil by means of the rolls which are eccentrically mounted on the shaft. The loose soil with the binding mortar is fed by the feeding augers from the central portion of the machine radially towards the hole wall, placed by means of the eccentric cylindrical roll and rolled into the compacted wall of the hole.

The disadvantage of this prior art machine resides in its inadequate reliability associated with the soil transfer along a duct narrowing towards the tail portion of the machine thus resulting in clogging of the duct, as well as in the absence of the possibility of extracting the machine back from the hole, since after the excavated soil is placed on the wall of the hole the diameter of the hole becomes smaller than the diameter of the machine.

Known in the art is another machine for making underground excavations, in particular holes in soil by compacting soil by rolling (cf. U.S. Pat. No. 3,926,267). The machine comprises an eccentric shaft having a conical member in the front end portion. Rolls are provided on the shaft journals, the axes of the shaft journals being inclined to the longitudinal axis of the machine in such a manner that the rolling path of the rolls comprises a three-dimensional spiral line. During rotation of the shaft, the conical member and tapered rolls eccentrically mounted on its journals compact the hole wall one after another to enlarge the diameter of the hole. Each next roll enters the portion of the hole formed by the foregoing roll thereby forming the walls of the hole. As the axes of the shaft journals on which the conical member and the rolls are mounted do not extend in parallel with the axis of the machine and are inclined in such a manner that a roll rolls over the hole wall along a spiral line, a component of the roll motion is developed owing to which the machine is fed only due to the shaft rotation without using any auxiliary mechanisms.

In this machine, a reaction torque from the eccentric shaft may be taken up, e.g. by a stabilizer mounted on the motor casing and cutting in the hole wall during the movement of the machine, or by wheels in an intimate contact with the hole wall.

The above-described machine is good for making holes of a relatively small diameter, up to about one meter. In making larger holes, e.g. several meters in diameter, the compaction zone around the hole is so large, that the top surface of the ground is raised to a slight extent, and the machine may emerge from the ground.

Another disadvantage of the machine, in making large-diameter holes, resides in the considerable power requirements for making holes associated with compaction of large soil masses expelled from the entire hole volume into the surrounding soil environment.

SUMMARY OF THE INVENTION

It is an object of the invention to eliminate the above-mentioned disadvantages of the above-described machines.

It is an object of the invention to provide a machine for making underground excavations of a large diameter in soil so as to ensure an adequate degree of soil compaction inside the hole and obtain strong and stable walls of the hole.

Still another object of the invention is to reduce the power requirements of the machine.

A further object of the invention is to improve the efficiency of hole driving.

The present invention resides in a machine for making underground excavations in soil by compacting the soil, comprising an eccentric shaft having journals on which are provided in a sequence, looking away from the face of the excavation being made, a conical member and tapered rolls defining in combination a conically expanding body, and mounted for free rotation about said eccentric shaft which is connected with a drive shaft of a drive for rotating the eccentric shaft and for longitudinally moving the machine within the excavation, according to the invention, the conical member has a through longitudinally extending diffuser passage, and the eccentric shaft also has a through longitudinal diffuser passage enlarging in the direction away from the face of the excavation being made, the smallest cross-sectional area of the passage of the conical member being smaller than the smallest cross-sectional area of the passage of the eccentric shaft by an amount such that the inside cross-sectional area of the passage of the conical member is, during operation of the machine, substantially within the limits of the smallest inside cross-sectional area of the passage of the eccentric shaft, and both passages defining in combination a through passage for the transfer of soil partially removed during operation of the machine.

This construction of the machine for making excavations in soil enables the core formation concurrently with the longitudinal and transverse movement of the cutting edge of the conical member provided in the front end portion of the machine, thereby considerably reducing an axial force required to force the machine into soil and preventing the machine passage from being clogged with soil. The passage enlarging towards the tail portion of the machine facilitates the removal of soil through the machine.

In an application where it is expedient to obtain a loose soil core, a knife facing with its cutting edge the face of the excavation being made is preferably provided in the passage of the eccentric shaft at right angle to the soil transfer direction, the knife being rigidly connected to the eccentric shaft wall and pivotally connected to the drive shaft of the drive. This facility enables the loosening of the soil core for subsequent transfer of soil through the inner space of the machine.

In certain applications, an electric drive motor is preferably installed in the passage of the eccentric shaft, the motor casing being externally provided with auger blades for the transfer of soil within the passage of the eccentric shaft. This construction of the machine contributes to a rapid removal of the loose soil core as it is entrained in the longitudinal direction by the auger blades.

In cases where it is desirable to obtain an integral intact soil core, an electric motor having a hollow rotor is preferably provided on the eccentric shaft on the side of the excavation being made, the rotor being rigidly connected with the eccentric shaft and embracing it in such a manner that the inner space of the rotor defines an extension of the passage of the eccentric shaft, and longitudinally extending ribs are provided externally on the motor casing to engage the wall of the excavation being made so as to take up the reaction torque. This construction of the machine enables an improvement of its efficiency owing to the production of soil cores facilitating their transportation without loosening them.

In certain applications it is desirable to provide on the eccentric shaft, on the side of the excavation being made, an electric motor having a hollow rotor rigidly connected with the eccentric shaft and embracing the eccentric shaft in such a manner that the inner space of the rotor defines an extension of the passage of the eccentric shaft, a stator being connected by means of a cam and disk clutch to the ultimate one of the tapered rolls, which are also interconnected by means of cam and disk clutches. This construction enables the rotation of the eccentric shaft relative to the rolls engaging the hole wall, thereby leaving the hole walls intact.

To simplify the construction of the machine for, making large-diameter holes, at least a part of the tapered rolls accommodate, on the eccentric shaft journals, electric drive motors having hollow rotors and mounted in such a manner that their rotors embrace the eccentric shaft journals and are rigidly connected thereto, and the stators are rigidly connected to the inner surface of respective tapered rolls. This construction of the machine enables a more rational utilization of the inner space of the machine and provides a compact means for making excavations in soil, motor cooling being also improved.

BRIEF DESCRIPTION OF THE DRAWINGS

Further objects and advantages of the invention will become apparent from the following detailed description of its embodiments with reference to the accompanying drawings, in which.

DESCRIPTION OF THE PREFERRED EMBODIMENTS

Figure 1:
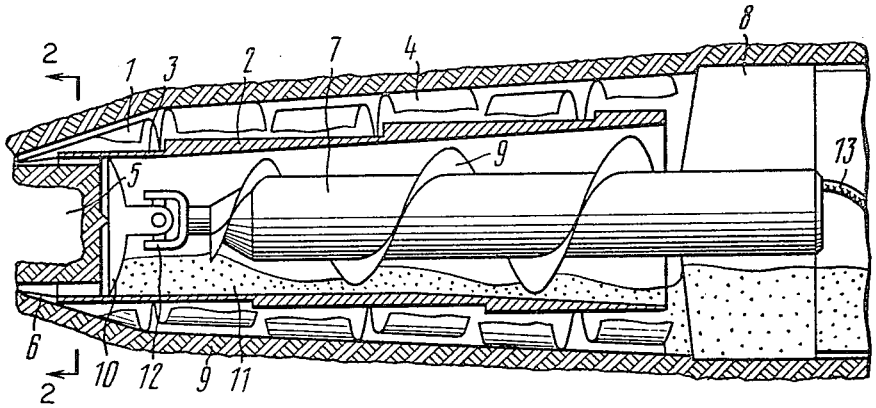
FIG. 1 is a longitudinal section of a machine for making underground excavations in soil, with an electric motor mounted inside the eccentric shaft, according to the invention.
Figure 2:
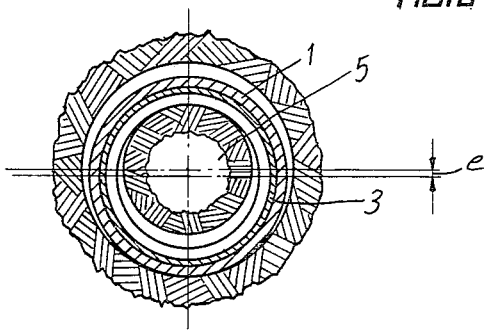
FIG. 2 is a transverse sectional view taken along the line 2—2 in FIG. 1.

A machine for making underground excavations in soil, according to the invention, comprises a conical member 1 (FIG. 1) mounted in front of an eccentric shaft 2 on its journal 3. Tapered rolls 4 are mounted behind the conical member 1 on respective journals of the shaft. Axes of the eccentric shaft 2 are inclined in such a manner that, during rotation of the shaft 2, the conical member 1 and the rolls 4 roll over a three-dimensional spiral line to cause a forward feed of the machine which is threaded into the soil. The eccentric shaft 2 has a through longitudinal diffuser passage, the passage expanding towards the tail portion of the machine. This contributes to the soil removal from the machine in driving horizontal or inclined ascending excavations. The conical member 1 (FIGS. 1 and 2) also has a through longitudinal diffuser passage, the smallest cross-sectional area of this passage being smaller than the smallest cross-sectional area of the passage of the eccentric shaft 2 so that the inside cross-sectional area of the passage of the conical member 1, during operation of the machine, is substantially within the limits of the smallest inside cross-sectional area of the passage of the eccentric shaft 2, and both passages defining in combination a through passage for the transfer of soil which is partially removed during operation of the machine. The diameter of the passage of the conical member 1 is smaller than the smallest diameter of the passage of the eccentric shaft 2 of the machine by at least two times the eccentricity "e" of the journal 3 of the shaft 2 on which is mounted the conical member 1 functioning as the first roll of the machine. This is done so as to ensure a free entrance of a core into the passage of the shaft 2 during the formation of a core 5, and movement of the machine within the excavation. A pointed edge of the conical member 1 is made to enlarge on the inner side 6 (FIG. 1). This facility reduces a force applied to the core during its formation by the conical member 1.

An electric motor 7 is accommodated in the passage of the eccentric shaft 2 and has at the end portion a stabilizer 8 in the form of longitudinally extending ribs to take up a reaction torque from the shaft 2 of the machine. With the diameter of a circle describing the stabilizer 8 being greater than the diameter of the hole being formed, the stabilizer penetrates the hole wall to retain the motor 7 against rotating in the direction opposite to the direction of rotation of the eccentric shaft 2. Auger blades 9 are provided on the outer surface of the motor 7, which contribute to the transfer of soil 11 loosened by means of a knife 10. The knife 10 also effects the coupling of the motor 7 and the eccentric shaft 2 by means of an articulation clutch 12. The electric motor 7 is supplied by means of a cable 13.

The above-described machine functions in the following manner. Before starting the machine, it is inserted into a prepared mouth having a longitudinal section corresponding to the longitudinal section of the machine in such a manner that at least several front end rolls 4 and the conical member 1 could engage the soil, and the stabilizer 8 would be able to take up a reaction torque. Upon energization of the motor 7, the shaft 2 starts rotating, and the rolls 4 rolling over the wall of the hole mouth begin feeding the machine forward to compact the soil and to form the walls of the hole. As the machine threads into the soil, and the reaction torque from the shaft 2 increases, the stabilizer 8 starts penetrating more compacted portions of the hole wall to completely take up the increasing torque. At the same time the soil core 5 is formed by the front end edge of the conical member 1, this process occurring owing to a complex motion of the conical member 1 which concurrently moves radially by the amount of two times the eccentricity "e" (FIG. 2) of the journal 3 of the shaft 2, rolls with the pointed edge thereof over the base of the core 5 due to the oblique position of the journal 3 of the shaft 2 for realization of a spiral path of movement, rotates about the longitudinal axis owing to the rolling over the hole wall in the direction opposite to the rotation direction of the shaft 2, and moves longitudinally together with the machine.

This motion of the edge of the conical member 1 enables a substantial reduction of the axial feed force applied to the machine and friction losses for soil core formation.

When the core 5 being formed approaches the knife 10 rotating together with the shaft 2, the core loosening begins. The soil 11 from the loosened core is entrained by the auger blades 9 mounted on the casing of the electric motor 7 and rapidly transferred through the passage of the shaft 2. The soil 11 is rolled inside the rotating shaft 2, and the auger blades 9 together with the casing of the motor 7 perform only a translation along the longitudinal axis of the excavation. The loosened soil 11 may be then extracted from the excavation by any appropriate known method using either a conveyor, or a loader, or compressed air.

This construction of the machine with the motor 7 located inside the eccentric shaft 2 allows the present invention to be operated by commonly known commercial electric motors or motor reducers without requiring the development of special motors for the manufacture of the machines of the present invention used for making underground excavations in soil.

Figure 3:
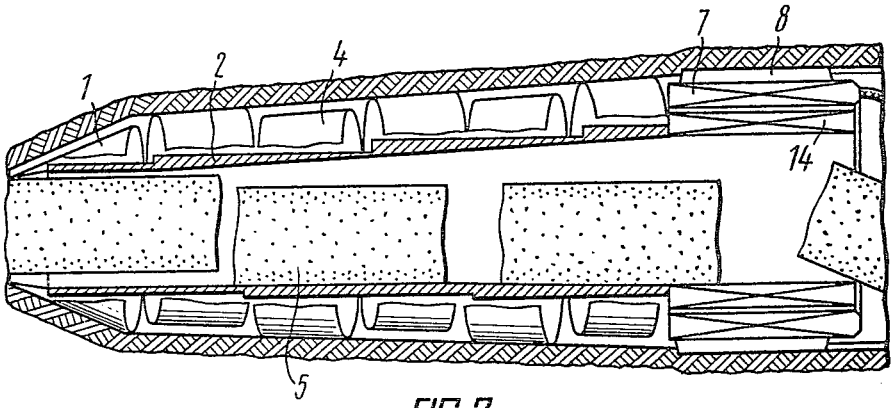
FIG. 3 shows an embodiment of a machine for making underground excavations in soil, according to the invention, which is driven by a motor having a hollow rotor, wherein a reaction torque is taken up by a stabilizer.

FIG. 3 shows another embodiment of the machine for making underground excavations in soil. This embodiment features an electric motor having a hollow rotor 14 connected to the eccentric shaft 2 in such a manner that the inner space of the rotor 14 defines an extension of the passage of the shaft 2. Longitudinally extending ribs forming the stabilizer 8 are provided on the casing 7 of the electric motor similarly to the above-described embodiment.

Operation of this machine is similar to that of the machine described above. The difference resides in that the soil core formed by the conical member 1 rolls within the passage of the rotating shaft 2, which expands as diffuser towards the tail portion of the machine, and moves along a spiral path backwards along the longitudinal axis of the machine towards the outlet of the machine, where it may be received by any appropriate conveying means.

This construction improves the efficiency of the machine owing to reduced losses for secondary comminution of soil occurring with the destruction of the formed core, as well as owing to an improved technique of soil removal from the excavation, which may involve loading and transportation of soil in the form of intact soil cores.

Figure 4:
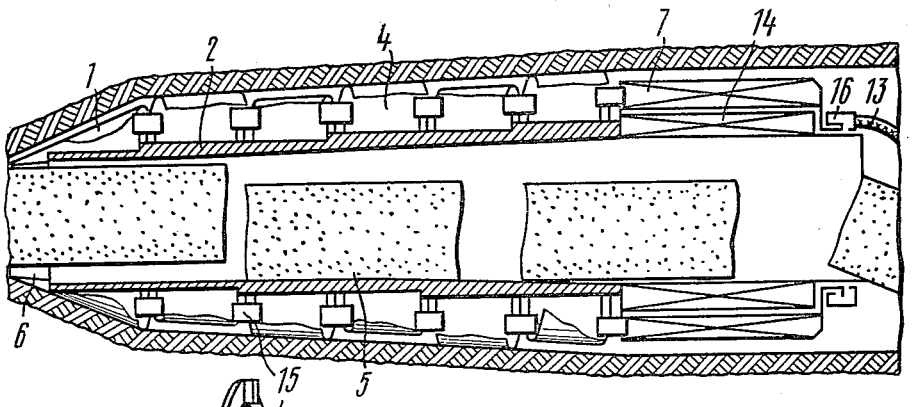
FIG. 4 shows an embodiment of a machine for making underground excavations in soil, according to the invention, with driven rolls coupled to a motor stator by means of cam and disk clutches.

FIG. 4 shows an embodiment of the machine, wherein a reaction torque from the eccentric shaft 2 is not taken up by means of a stabilizer, as was the case with the above-described embodiments, but rather is absorbed by means of the tapered rolls used for soil compaction and axial feed of the machine.

Figure 5:
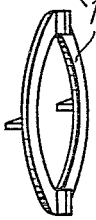
FIG. 5 shows a cam and disk clutch of the machine for making underground excavation in soil shown in FIG. 4.

In addition to the above-described elements of the machine for making excavations in soil, the machine also comprises cam and disk clutches 15 (FIG. 5) provided between the tapered rolls 4, and in the space between the ultimate roll and the motor stator. The clutches 15 have projections received in respective recesses of the end faces of the rolls and stator. The cam and disk clutches 15 are designed to transmit the reaction torque from the stator of the motor 7 to the tapered rolls 4 which are not coaxial with one another. Electric energy is fed to the motor 7 by means of a sliding contact member 16 and the power supply cable 13. As differentiated from the above-described machines, the eccentric shaft 2 in this embodiment is made in such a manner that the eccentricities of its journals are proportional with the diameters of respective rolls, that is the relative eccentricities of the shaft journals are equal to one another. In this embodiment each roll rolls over the hole at the same angular speed without inducing stresses in the clutches 15, which would otherwise develop owing to nonsynchronous rotation thereof relative to one another.

The machine functions in the following manner. Upon energization of the motor, the rotor 14 rigidly connected with the eccentric shaft 2 starts rotating in one direction, and the stator of the machine, as well as the rolls 4 and the conical member 1 connected thereto by means of the cam and disk clutches 15, start rotating in the opposite direction, and the machine starts threading into the soil similarly to the above-described machines. Owing to the provision of the member 16, the cable 13 moves only longitudinally, whereas all other elements of the machine rotate—the rotor 14 with the shaft 2 in one direction, and the stator with the rolls and conical member 1, in the other direction.

This construction of the machine in which the reaction torque is taken up by the rolling members themselves, which are interconnected and coupled to the motor stator by means of clutches enables an improvement of quality of the excavation wall and reduces soil friction losses resulting from absorption of the reaction torque from the eccentric shaft.

Figure 6:
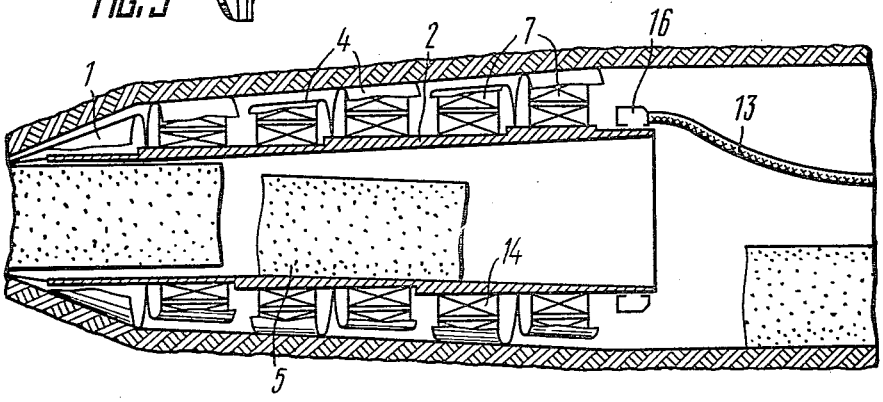
FIG. 6 shows an embodiment of a machine for making underground excavations in soil, according to the invention, comprising electric motors incorporated in the rolls.

Still another embodiment of the present invention shown in FIG. 6, comprises hollow rotors 14 of electric motors which are rigidly mounted on journals of the eccentric shaft 2, and stators accommodated in respective rolls 4. In this embodiment, having motors incorporated in the rolls 4, the operation is similar to that described above. The difference in this case resides in that the electric drive motors with hollow rotors are accommodated in the tapered rolls 4 on the journals of the eccentric shaft 2 so that the rotors embrace the journals of the eccentric shaft 2 and are rigidly connected thereto, and the stators are rigidly connected to the inner surface of the respective tapered rolls 4. The rolls are not rigidly connected to one another and may rotate at different speeds, while the equality of relative eccentricities of the journals of the shaft 2 may be dispensed with. This embodiment features the most rational relative arrangement of elements so that a compact structure is achieved. Another advantage of this embodiment resides in an improved cooling of the electric motors mounted inside the rolls in intimate contact with a cool wall of the excavation being made.

What is claimed is:

1. A machine for making underground excavations by compacting soil, comprising:

an eccentric shaft having journals eccentric relative to one another; a conical member provided in front of the eccentric shaft on the side of the face of the excavation being made;

tapered rolls mounted in a sequence, looking away from the face of the excavation being made behind said conical member, on said journals of said eccentric shaft, said rolls defining, in combination with said conical member, a conically expanding body, the tapered rolls being mounted for free rotation about said eccentric shaft;

a drive for rotating said eccentric shaft and for longitudinally moving said machine within the excavation;

a through longitudinal diffuser passage in said conical member;

a through longitudinal diffuser passage in said eccentric shaft, the cross-sectional area of said passage of the eccentric shaft enlarging in the direction away from the face of the excavation being made, and the smallest cross-sectional area of said passage of the conical member being smaller than the smallest cross-sectional area of said passage of the eccentric shaft so that said inside cross-sectional area of said passage of the conical member, during operation of the machine, is substantially within said inside cross-sectional area of the eccentric shaft, and both passages defining in combination a through passage for the transfer of soil partially removed during operation of the machine.

2. A machine according to claim 1, wherein there is provided a knife mounted in said passage of the eccentric shaft at right angle to the direction of soil transfer, the cutting edge of the knife facing the face of the excavation being made, the knife being rigidly coupled to the wall of said eccentric shaft and pivotally connected to said drive shaft of the drive.

3. A machine according to claim 1, wherein in said passage of the eccentric shaft is mounted an electric motor of said drive having auger blades provided externally of the casing thereof for the transfer of soil within said passage of the eccentric shaft.

4. A machine according to claim 1, wherein on said eccentric shaft, on the side of the excavation being made, is provided an electric motor of said drive having a hollow rotor rigidly connected to said eccentric shaft to embrace it in such a manner that the inner space of said rotor defines an extension of said passage of the eccentric shaft, and longitudinally extending ribs are provided externally at the casing of the electric motor to engage the wall of the excavation being made to take up a reaction torque.

5. A machine according to claim 1, wherein on the eccentric shaft, on the side of the excavation being made, is provided an electric motor having a hollow rotor rigidly connected said eccentric shaft to embrace it in such a manner that the inner space of the rotor defines an extension of the passage of said eccentric shaft, the stator being coupled by means of a cam and disk clutch to the ultimate one of said tapered rolls which are also interconnected by means of cam and disk clutches.

6. A machine according to claim 1, wherein on the journals of said eccentric shaft, inside at least a part of said tapered rolls, are provided electric motors of said drive, having hollow rotors in such a manner that the rotors embrace the journals of said eccentric shaft and are rigidly connected thereto, and the stators are rigidly connected to the inner surface of the tapered rolls.

* * * * *